US006452328B1

(12) United States Patent
Saito et al.

(10) Patent No.: US 6,452,328 B1
(45) Date of Patent: Sep. 17, 2002

(54) ELECTRON EMISSION DEVICE, PRODUCTION METHOD OF THE SAME, AND DISPLAY APPARATUS USING THE SAME

(75) Inventors: Ichiro Saito; Koichi Iida; Tokiko Takahashi, all of Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/232,847

(22) Filed: Jan. 19, 1999

(30) Foreign Application Priority Data

Jan. 22, 1998 (JP) ..... 10-010676

(51) Int. Cl.[7] ..... H01J 31/15

(52) U.S. Cl. ..... 313/495; 313/309; 313/310; 313/311

(58) Field of Search ..... 313/495, 309, 313/310, 311; 445/24, 50

(56) References Cited

U.S. PATENT DOCUMENTS

| | | | | |
|---|---|---|---|---|
| 4,663,559 A | * | 5/1987 | Christensen | 313/310 X |
| 5,608,283 A | | 3/1997 | Twichell et al. | 313/309 |
| 5,619,093 A | | 4/1997 | Glesener et al. | 313/309 |
| 5,900,301 A | * | 5/1999 | Brandes et al. | 428/77 |
| 5,948,465 A | * | 9/1999 | Blanchet-Fincher et al. | 445/50 |

FOREIGN PATENT DOCUMENTS

| | | | |
|---|---|---|---|
| EP | 0 555 074 A1 | 3/1993 | H01J/1/30 |
| EP | 0 572 777 A1 | 3/1993 | H01J/31/12 |
| EP | 0 725 415 A2 | 1/1996 | H01J/9/02 |
| EP | 0 709 869 A1 | 5/1996 | H01J/1/30 |
| EP | 0 718 684 A1 | 6/1996 | H01J/1/30 |
| WO | PCT/US90/05193 | 4/1991 | H01J/9/02 |
| WO | WO 97/06549 | 2/1997 | |
| WO | PCT/US96/18145 | 5/1997 | H01J/9/02 |

* cited by examiner

*Primary Examiner*—Ashok Patel
(74) *Attorney, Agent, or Firm*—Rader, Fishman & Grauer PLLC; Ronald P. Kananen

(57) ABSTRACT

The present invention provides an electron emission device assured to emit electrons without requiring film thickness control on the order of submicrons and a production method of the electron emission device as well as a display apparatus using the electron emission device. The electron emission device includes a cathode electrode consisting of conductive fine particles adhered directly onto a substrate and electrons are emitted from these conductive fine particles when a predetermined electric field is applied.

31 Claims, 14 Drawing Sheets

ELECTRON EMISSION DEVICE, PRODUCTION METHOD OF THE SAME, AND DISPLAY APPARATUS USING THE SAME

BACKGROUND OF THE INVENTION

1. Field of the Invention

The present invention relates to an electron emission device used in a so-called field emission type display apparatus, a production method of the electron emission device, and a display apparatus using the electron emission device.

2. Description of the Prior Art

Recently, the development of display devices has been directed to make the devices thinner. To achieve this special attention has been paid to, a so-called field emission type display (hereinafter, referred to as FED).

As shown in FIG. 1, in an FED, for one pixel, there are provided a spindt type electron emission device 100 and a fluorescent panel 101 formed opposite to this electron emission device 100. Such pixels are formed in a matrix to constitute a display.

The portion corresponding to one pixel includes an electron emission device 100 having: a cathode electrode 103 formed on a cathode panel 102; an insulation layer 104 formed on the cathode electrode 103; a gate electrode 105 layered on this insulation layer 104; a hole portion 106 formed through the gate electrode and the insulation layer 104; and an electron emission emitter 107 formed inside the holde portion 106. Moreover, this FED includes a fluorescent plane 101 arranged so as to oppose the electron emission device 100 and having a front panel 108, an anode electrode 109 formed on this front panel 108, and a fluorescent body 110. Furthermore, this FED is constituted so that a predetermined voltage is applied to the cathode electrode 103, the gate electrode 105, and the anode electrode 109.

In this FED, the electron emitter 107 is made from material such as W, Mo, and Ni processed approximately into a small conical shape with its tip positioned at a predetermined distance from the gate electrode. This electron emission device 100 emits electrons from the tip of the electron emitter 107 and includes a number of the electron emitters 107.

In the FED having such a configuration, a predetermined electric field is generated between the cathode electrode 103 and the gate electrode 105. This causes electrons to be emitted from the tip of the electron emitter 107. The electrons emitted strike the fluorescent body 110 formed on the anode electrode 109. This excites the fluorescent body 110 to emit light. The FED controls the quantity of the electrons emitted from the electron emitter 107 for each pixel to display a desired image.

More specifically, in the FED, the hole portion 106 has an opening dimension of about 1 micrometer or less; and the electron emitter 107 has a height of 1 micrometer or less and the base of electron emitter 107 has a curvature radius in the order of several tens of nm. Moreover, in the FED, one pixel has several tens to several thousands of electron emitters 107. For example, in a display of XGA class in which the number of pixels is 1024×768× (RGB), it is necessary to provide 100 to 100000 millions of electron emitters 107.

A voltage of several tens of volts is applied from the cathode electrode 103 to the gate electrode 105, so as to generate an electric field in the order of $10^7$ V/cm between the gate electrode 105 and the tip of the of the electron emitters 107. Moreover, a voltage on the order of 200 to 5000 V is applied to the anode electrode 109, so that electrons emitted from the electron emitter 107 strike the fluorescent plane 101.

However, the FED described above having the electron emitters 107 of the spindt type has problems as follows.

First of all, the spindt type electron emitter 107 is formed on a microscopic scale, requiring a submicron accuracy. Accordingly, it is necessary to employ a process and apparatus identical to those for producing an integrated circuit (IC) to form the FED. However, for example, when preparing a display having a screen of 17-inch size in a diagonal direction, the apparatus size becomes too large, significantly increasing the costs. Besides, if the display is to have a large size, the production yield is remarkably lowered because the electron emitters 107 need be formed uniformly over the entire cathode panel surface.

Secondly, the electron emitter 107 is made from a material such as W, Mo, and Ni, and an electric field in the order of $10^7$ V/cm is required between the cathode electrode 103 and the gate electrode 105. In order to satisfy these parameters while maintaining the small voltage applied, the interval between the gate electrode 105 and the electron emitter 107 must be a submicron or less. However, it is quite difficult to form a submicron interval without short-circuiting the gate electrode 105 and the cathode electrode 103. Thus, the production yield is significantly lowered.

Thirdly, the material W, Mo, or Ni constituting the electron emitters 107, for example, is eroded by the collision of ions generated from a residual gas and from the fluorescent body 110 and is rapidly deteriorated. Thus, in the FED having this spindt type electron emitter 107, the vacuum degree of the portion containing the electron emitter 107 must be reduced. More specifically, it is necessary to maintain a vacuum 10 times lower than the vacuum degree of an ordinary cathode ray tube 10" to 10−7 Torr. In order to reach such a low vacuum, it is necessary to greatly increase the mechanical strength of the display, preventing reduction in the apparatus size including the thickness and weight.

In contrast to this spindt type electron emitters 107, a there has been suggested an electron emission device including an electron emitter of conductive fine particle type. An electron emission device including this conductive fine particle type electron emitter is disclosed, for example, in PCT/GB96/01858 [1] and WO 97/06549 [2], wherein conductive fine particles are contained in a dielectric layer, i.e., the conductive fine particles are covered with a dielectric layer so as to be arranged via the dielectric layer onto a conductive layer.

This conductive fine particle type electron emitter generates an electric field when a voltage is applied to the conductive layer. This electric field causes the conductive fine particles to emit electrons. In this case, the electron emitter can be formed easier than the aforementioned spindt type and is appropriate for a large-screen flat display that can be produced with a reasonable production cost.

Moreover, U.S. Pat. No. 5,608,283 [3] discloses an electron emission device including a conductive fine particle type electron emitter wherein conductive fine particles are provided on a high-resistance pillar formed on a conductive layer and on the conductive layer via a bonding layer.

This electron emitter also generates an electric field so that the conductive fine particles arranged on the bonding layer, and the like, emit electrons. In this case also, the electron emitter can be produced easier than the aforementioned spindt type and is appropriate for a large-screen flat display that can be produced at a reasonable cost.

On the other hand, in the electron emission device disclosed in Documents [1] and [2], it is necessary to accurately define the thickness of the dielectric layer between the conductive fine particles and the conductive layer as well as the thickness of the dielectric layer covering the conductive fine particles. More specifically, each of these thickness values should be on the order of 1/10 to 1/100 of the conductive fine particle diameter, i.e., several hundreds Angstroms.

However, it is quite difficult to control the thickness of the dielectric layer on the order of several hundreds of Angstroms. In this electron emission device, if it is impossible to control the thickness of this dielectric layer with a high accuracy, it is impossible to selectively emit electrons, thereby preventing use of the device as a display for displaying an image. That is, such an electron emission device having a difficulty in controlling the thickness of the dielectric layer cannot be used for an image display apparatus such as the FED.

Moreover, in the electron emission device as disclosed in Document [3], conductive fine particles are arranged so as to be fixed by the bonding layer. In this electron emission device, if the conductive fine particles are covered by the bonding layer, emission of electrons is disabled. In order to form a bonding layer without covering the conductive fine particles, it is necessary to control the thickness of the bonding layer to be several hundreds of Angstroms.

However, it has been difficult to control the thickness of the bonding layer to several hundreds of Angstroms. In such an electron emission device, because of the difficulty to controlling the thickness of the bonding layer with a high accuracy, the conductive fine particles may be embedded into the bonding layer, preventing the reliable emission of electrons.

SUMMARY OF THE INVENTION

It is therefore an object of the present invention to solve the aforementioned problems of the aforementioned conventional electron emission device so as to provide an electron emission device capable of assuring emission of electrons without requiring the control of the film thickness on a submicron scale, and a production method of such an electron emission device as well as a display apparatus using the electron emission device.

The electron emission device that solves the aforementioned problem includes a cathode electrode of conductive fine particles formed on a substrate, wherein the conductive fine particles are adhered directly onto the substrate and electrons are emitted from the conductive fine particles when a predetermined electric field is applied.

In this electron emission device, generation of an electric field causes the conductive fine particles to emit electrons. In this electron emission device, the conductive fine particles are adhered directly onto the substrate. Accordingly, this electron emission device does not require an adhesive layer or the like for fixing the conductive fine particles onto the substrate. Consequently, this electron emission device has a configuration such that the conductive fine particles can easily emit electrons.

Moreover, in the electron emission device according to the present invention, it is preferable that those portions of the conductive fine particles adhered directly onto the substrate are held by a glass material.

In this case, the electron emission device has the conductive fine particles which are firmly fixed by the glass material onto the substrate. This can prevent peeling off of the conductive fine particles from the substrate.

On the other hand, the electron emission device production method according to the present invention includes: a step of applying a conductive paint containing conductive fine particles and binder onto a substrate to form a film there; and a step of sintering the conductive paint film formed on the substrate, so as to remove the binder, thus adhering the conductive fine particles directly onto the substrate.

In this electron emission device production method, the conductive paint film is sintered to remove a binder contained in the conductive paint film. Thus, the conductive fine particles can be adhered to the substrate by the Van der Waals force. Accordingly, the conductive fine particles can be firmly fixed to the substrate. That is, this method does not require formation of an adhesive layer for fixing the conductive fine particles onto the substrate. Moreover, in this method, because there is no need to form an adhesive layer or the like, the conductive fine particles need not be covered.

Moreover, in the electron emission device production method according to the present invention, it is possible to carry out a surface treatment after removing the binder by sintering.

In this case, the surface treatment of the conductive fine particles can remove impurities such as a binder completely from the surfaces of the conductive fine particles. Moreover, the conductive fine particles after being subjected to the surface treatment have exposed portions activated.

Furthermore in the electron emission device production method according to the present invention, the conductive paint may contain a glass material, and the conductive paint applied onto the substrate is sintered to remove the binder, so that the conductive fine particles are adhered directly onto the substrate and the glass material contained in the conductive paint film is precipitated so as to hold portions of the conductive fine particles adhered directly onto the substrate.

In this case, the conductive paint film containing the glass material is sintered to remove the binder and the like and settle the glass material onto the substrate. In this method, the settled glass material covers the adhesion portion of the conductive fine particles. This further fixes the conductive fine particles firmly onto the substrate.

Furthermore, the display apparatus according to the present invention includes: an electron emission device including a cathode electrode having a plurality of conductive fine particles arranged on a substrate; an anode electrode arranged to oppose the electron emission device so as to generate an electric field to accelerate electrons emitted from the electron emission device; and a fluorescent plane arranged on the anode electrode to be struck by electrons accelerated by the anode electrode. In this display apparatus, the cathode electrode has the plurality of conductive fine particles adhered directly onto the substrate and emits electrons when a predetermined electric field is present and the electrons emitted from the cathode electrode cause the fluorescent plane to emit light.

In the display apparatus having the aforementioned configuration according to the present invention, electrons are emitted from the conductive fine particles adhered directly onto the substrate. In this display apparatus, the electrons thus emitted are accelerated by the electric field generated by the anode electrode to strick the fluorescent plane. This causes the fluorescent plane to emit light, to display an image.

DETAILED DESCRIPTION OF PREFERRED EMBODIMENTS

Hereinafter, description will be directed to an electron emission device, its production method, and a display apparatus using the electron emission device according to specific embodiments of the present invention.

Figure 1:
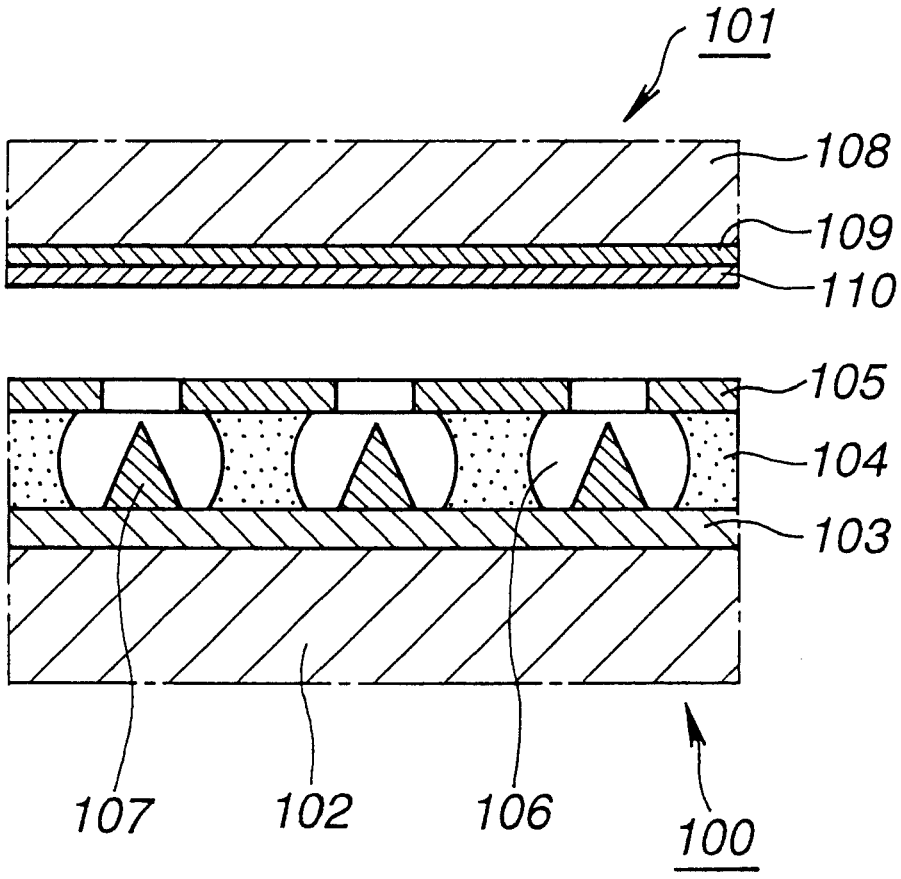
FIG. 1 is a cross sectional view showing an essential portion of a display apparatus using a conventional electron emission device.
Figure 2:
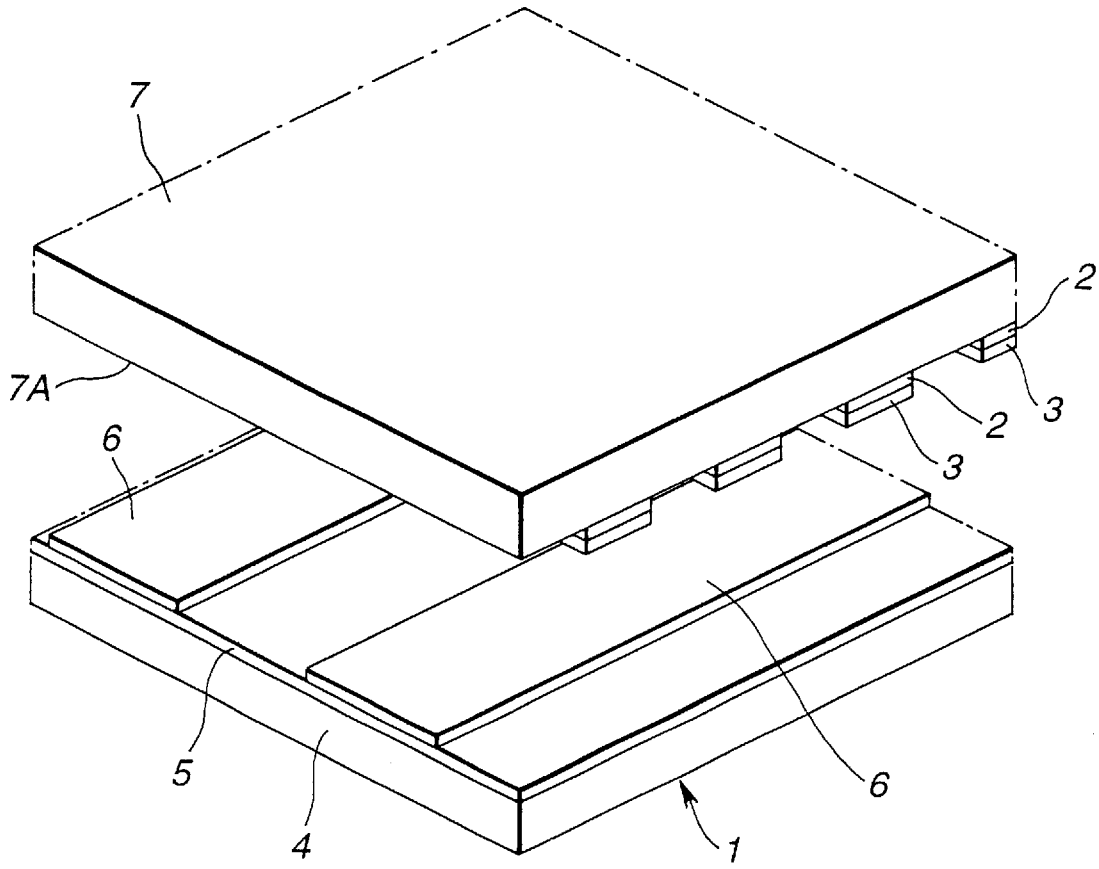
FIG. 2 is a perspective view showing a configuration of a display apparatus using an electron emission device according to the present invention.

As shown in FIG. 2, the electron emission device according to the present invention is applied to a so-called field emission display (FED). The FED includes an electron emission device 1, and anode electrodes 2 and fluorescent planes 3 arranged at an identical interval so as to oppose to the electron emission device 1. In this FED, a high-degree vacuum state is maintained between the electron emission device 1 and the anode electrodes 2 together with the fluorescent planes 3.

In this FED, the electron emission device 1 includes a glass substrate 4 and a cathode electrode 6 containing conductive fine particles such as graphite and arranged via an undercoat glass 5 on the glass substrate 4.

The glass substrate 4 is formed approximately in a rectangular thin plate shape and has a predetermined strength to endure the aforementioned vacuum state. The undercoat glass 5 is made from a glass paint of absorption type applied to have a thickness of about 10 micrometers.

Figure 3:
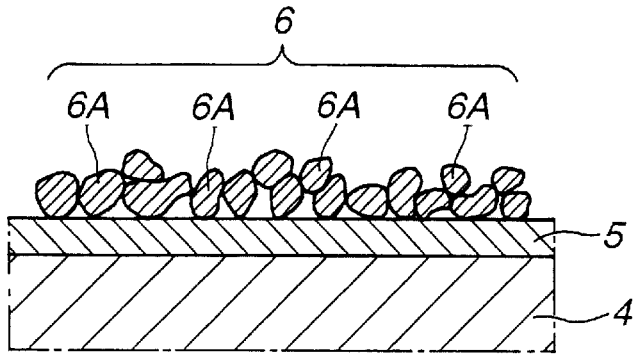
FIG. 3 is a cross sectional view showing an an example of a cathode electrode of the electron emission of the present invention.

The cathode electrode 6, as will be detailed later, is made from a conductive paste applied with a predetermined width onto the undercoat glass 5 which is then sintered. As shown in FIG. 3, the cathode electrode 6 is formed with conductive fine particles 6A such as graphite particles directly adhered to the undercoat glass 5 in a band shape of a predetermined width. Here, the conductive fine particles 6A adhere to the substrate with Van der Waals force. Moreover, the conductive fine particles 6A having a certain density are electrically connected to one another.

Moreover, in this FED, a plurality of the cathode electrodes 6 are formed at a predetermined interval in parallel to one another. More specifically, in a case of FED having a display of 20-inch size in diagonal direction, each cathode electrode 6 has a width of about 100 micrometers and an interval between adjacent cathode electrode 6 is about 100 micrometers.

Furthermore, in this FED, a power source is attached to each of the cathode electrodes 6. This allows selective application of a voltage to the respective cathode electrodes 6.

The conductive fine particles 6A used for this cathode electrode 6, for example, may be graphite as a single substance; a mixture of graphite particles with barium oxide; a mixture of strontium, oxide, or metal with graphite particles; diamond particles containing impurities such as nitrogen, phosphorous, boron, and triazol; diamond-like carbon containing impurities such as nitrogen, phosphorous, boron, and triazol; silicon carbide; and the like.

Moreover, the conductive fine particles 6A may have any configurations, i.e., may have regular shapes such as a sphere or scale, or may have irregular shapes. As for the particle size of the conductive fine particles 6A, it can be determined according to the width of the cathode electrode 6. For example, in a case of cathode electrode 6 having a width of 100 micrometers, it is possible to use any particles having diameters of 100 micrometers or less, and more preferably in a range from 0.1 to 4.0 micrometers. It should be noted that as the particle size becomes smaller, an electron quantity emitted per unit area is increased, which is preferable. However, if the particle size is smaller than 0.1 micrometers, the conductivity of the cathode electrode 6 may be deteriorated.

The anode electrode 2 and the fluorescent plane 3 are arranged to oppose the cathode electrode 6.

That is, the anode electrode 2 and the fluorescent plane 3 are formed on an opposing surface 7A of a front side glass substrate 7 provided parallel to the aforementioned glass substrate 4. In this FED, the anode electrode 2 is formed on the opposing surface 7A of the front side glass substrate 7 in stripes in a direction perpendicular to the aforementioned cathode electrode 6. The fluorescent plane 3 is formed on the anode electrode 2 with three fluorescent bodies of red (R), green (G), and blue (B), constituting an RGB pattern.

Moreover, in this FED, the anode electrode 2 and the fluorescent plane 3 have a width of about 66 micrometers and a distance between adjacent anode electrodes and fluorescent planes 3 is also about 66 micrometers. Accordingly, when this FED is viewed from the front side glass substrate 7, a plurality of anode electrodes 2 vertically intersect a plurality of cathode electrodes 6, constituting a matrix. In other words, in this FED, the cathode electrodes 6 make a two-level crossing with the anode electrodes 2 and the fluorescent planes 3.

In this FED, each of the portions of the RGB pattern formed on a anode electrode and overlaid with a cathode electrode 6 constitutes a pixel. That is, in ths FED, each of the crossing areas of an anode electron 2 and a cathode electrode 6 in a matrix shape constitute a pixel.

Each of the anode electrodes 2 is made from a colorless transparent conductive material such as ITO (mixed oxide of In and Sn) and attached to a power source. Thus, a predetermined voltage is selectively applied to the respective anode electrodes 2.

In the FED having the aforementioned configuration, electrons emitted from the electron emission device 1 strike the fluorescent bodies to display an image.

In this FED, a predetermined voltage is applied so that the anode electrodes 2 are positive with respect to the cathode electrode 6. Thus, a predetermined electric field is generated corresponding to the area between a pair of the cathode electrode 6 and the anode electrode 2, i.e., an area corresponding to the pixel. When this electric field exceeds a threshold value, electrons are emitted from the conductive fine particles 6A of the cathode electrode 6. Here, the electrons are emitted from a side of the conductive fine particles 6A facing the anode electrode 2.

Figure 4:
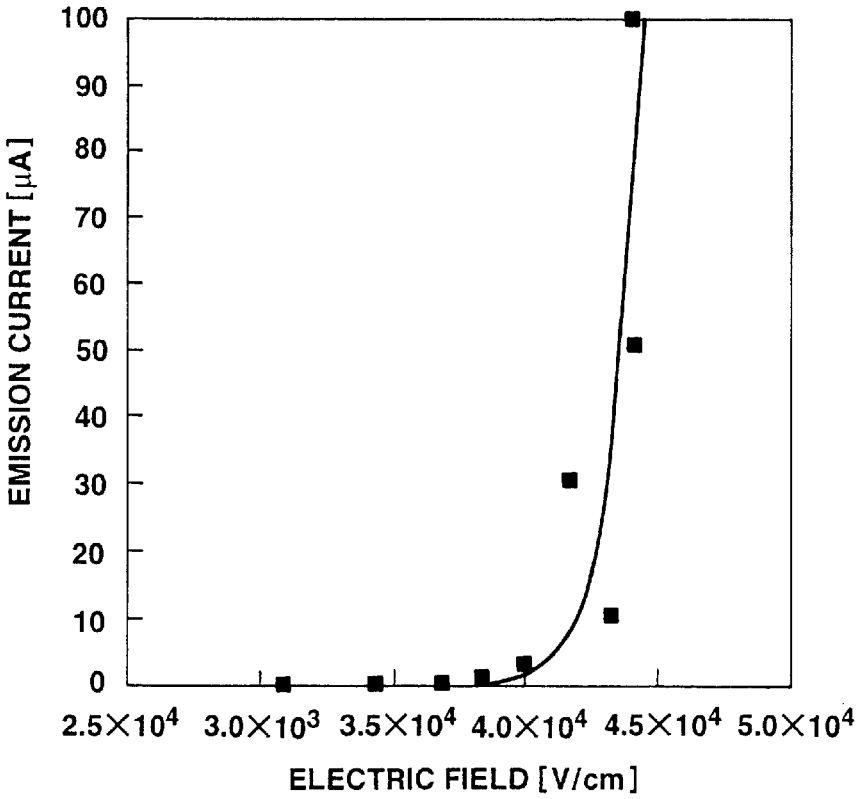
FIG. 4 shows a relationship between an electric field intensity and an electron emission quantity.

More specifically, when conductive fine particles 6A are graphite particles, the threshold value is on the order of $4.5\times10^4$ V/cm as shown in FIG. 4. It should be noted that this threshold value varies depending on the configuration, density, and surface state of the conductive fine particles 6A. In the case of graphite particles, the threshold value is on the order of $5\times10^4$ to $5\times10^5$ V/cm. Moreover, here a voltage applied to the anode electrode 2 should be positive in relation to the cathode electrode 6. The voltage applied to the cathode electrode 6 need not be 0 V.

Thus, the electron emission device 1 according to the present invention uses the conductive fine particles 6A adhered directly to the undercoat glass 5. Accordingly, compared to the conventional spindt type electron emission device the threshold value of the field emission is low. In the conventional spindt type electron emission device, the cathode electrode is W, Mo, or the like formed into a conical shape, requiring an electric field in the order of $10^7$ V/cm for field emission.

In contrast to this, in the electron emission device 1 according to the present invention, conductive fine particles 6A such as graphite are used and accordingly, the threshold value of the electric field for electron emission is reduced. Consequently, in the electron emission device 1, the voltage applied to the cathode electrode 6 is reduced. That is, it is possible the display device with a lower power consumption.

Thus, in the FED, electrons are emitted from the cathode electrodes 6 corresponding to the respective pixels. This causes the pixels to emit light, constituting an image over the entire FED.

More specifically, on a screen to display an image, the anode electrodes 2 are arranged in horizontal directions and the cathode electrodes are arranged in vertical directions. A vertical synchronization signal is used to successively apply a constant voltage to the respective anode electrodes. In this state, a voltage with a threshold voltage set to the black level is applied to the cathode electrodes 6 according to a horizontal synchronization signal. When displaying an image, an image signal sampled according to the respective pixels is applied to the cathode electrodes 6 and the anode electrodes 2 constituting pixels. Thus, the respective pixels can display desired colors to display an image.

It should be noted that in this FED, the method for driving the electron emission devices and anode electrodes 2 constituting the pixels is not to be limited to the aforementioned method.

In the aforementioned electron emission device and the display apparatus using the electron emission device according to the present invention, the conductive fine particles 6A are adhered directly onto the undercoat glass 5 and their surfaces are exposed outward. Moreover, the conductive fine particles 6A are chemically stable. The conductive fine particles 6A are especially stable chemically when containing a carbon material as a main constituent such as graphite and diamond.

In contrast to this, in the conventional spindt type electron emission device, the cathode electrodes are made from a metal such as W, Mo, and Ni or silicon. Accordingly, the cathode electrodes are deteriorated, for example, by attack by ions. Consequently, in the conventional electron emission device, the cathode electrodes need be used in a high vacuum. More specifically, in the conventional electron emission device, it is necessary to maintain a vacuum of $10^{-7}$ to $10^{-8}$ Torr or below which ten times below the vacuum degree of the cathode ray tube.

On the other hand, in the electron emission device 1 according to the present invention, the conductive fine particles 6A are chemically stable. Even if an ion strike a cathode electrode 6, the conductive fine particles 6A struck are only exposed as an active portion, and the cathode electrode 6 will not be deteriorated. Consequently, the electron emission device 1 can be driven in a vacuum on the order of $10^{-6}$ to $10^{-7}$ Torr like the vacuum degree of a cathode ray tube. Thus, the display apparatus using this electron emission device 1 does not require a high-degree vacuum, facilitating the structure design and permitting a large-size screen.

Moreover, in the conventional electron emission device using conductive fine particles, the conductive fine particles are surrounded by a high-resistance material and a dielectric material. The high-resistance material and the dielectric material must be formed as a film with thickness in the order of several hundreds of Angstrom. This film formation is difficult in the production procedure, and if this high-resistance material and the dielectric material are absent, there arises a problem that field emission is not carried off. That is, ion attack peels out the high-resistant layer from the surface, disabling selective electron emission.

On the other hand, in the electron emission device 1 according to the present invention, even if the conductive fine particles 6A are struck by ions, the affected portion is simply cleaned. For this, in the electron emission device 1 according to the present invention, the conductive fine particles 6A, even after being struck by ions, can preferably emit electrons. That is, in the display apparatus using this electron emission device 1, the conductive fine particles 6A can always have a selective electron emission characteristic, enabling the device to display an image.

Furthermore, in the electron emission device and the display apparatus according to the present invention, it is possible to increase an electron quantity emitted per unit area by increasing the density of the conductive fine particles 6A. In other words, in this electron emission device and the display apparatus, the electron emission quantity can be increased simply by increasing the density of the conductive fine particles. Thus, in this electron emission device, it is possible to easily increase the electron emission quantity. Consequently, in the display apparatus, it is possible to significantly increase the luminance compared to conventional display devices.

Figure 5:
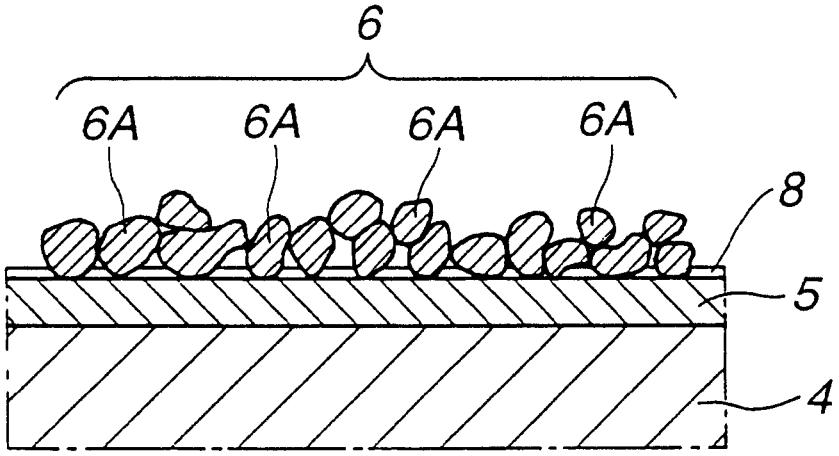
FIG. 5 is a cross sectional view showing another example of the cathode electrode of the electron emission device.

The electron emission device according to the present invention is not limited to the configuration shown in FIG. 3 but can have a configuration as shown in FIG. 5 where a glass material 8 is provided. In this case, the electron emission device includes; the glass substrate 4, the undercoat glass 5; the cathode electrode 6 having the conductive fine particles 6A provided via the undercoat glass 5 on the glass substrate 4; and the glass material 8 holding the conductive fine particles 6A adhered directly to the undercoat glass 5.

In this electron emission device, the cathode electrode 6 is formed from a conductive paste containing a glass content and applied with a predetermined width and then sintered. Thus, as shown in FIG. 5, the cathode electrode is formed by the conductive fine particles 6A adhered directly to the undercoat glass 5 and those portions of the particles 6A, where the conductive fine particles 6A are adhered directly to the undercoat glass 5 are covered by the glass material 8. Here, the conductive fine particles 6A are adhered to the undercoat glass 5 with the Van der Waals force and further firmly fixed to the undercoat glass 5 by the glass material 8.

In the electron emission device having the aforementioned configuration, the conductive fine particles 6A are adhered directly to the undercoat glass 5 comparatively firmly. Accordingly, in this electron emission device, the conductive fine particles 6A will not be peeled off from the undercoat glass. Consequently, even if this electron emission device is subjected to an abnormal vibration or force, the electron emission device will not be damaged and can exhibit a stable electron emission characteristic.

Figure 6:
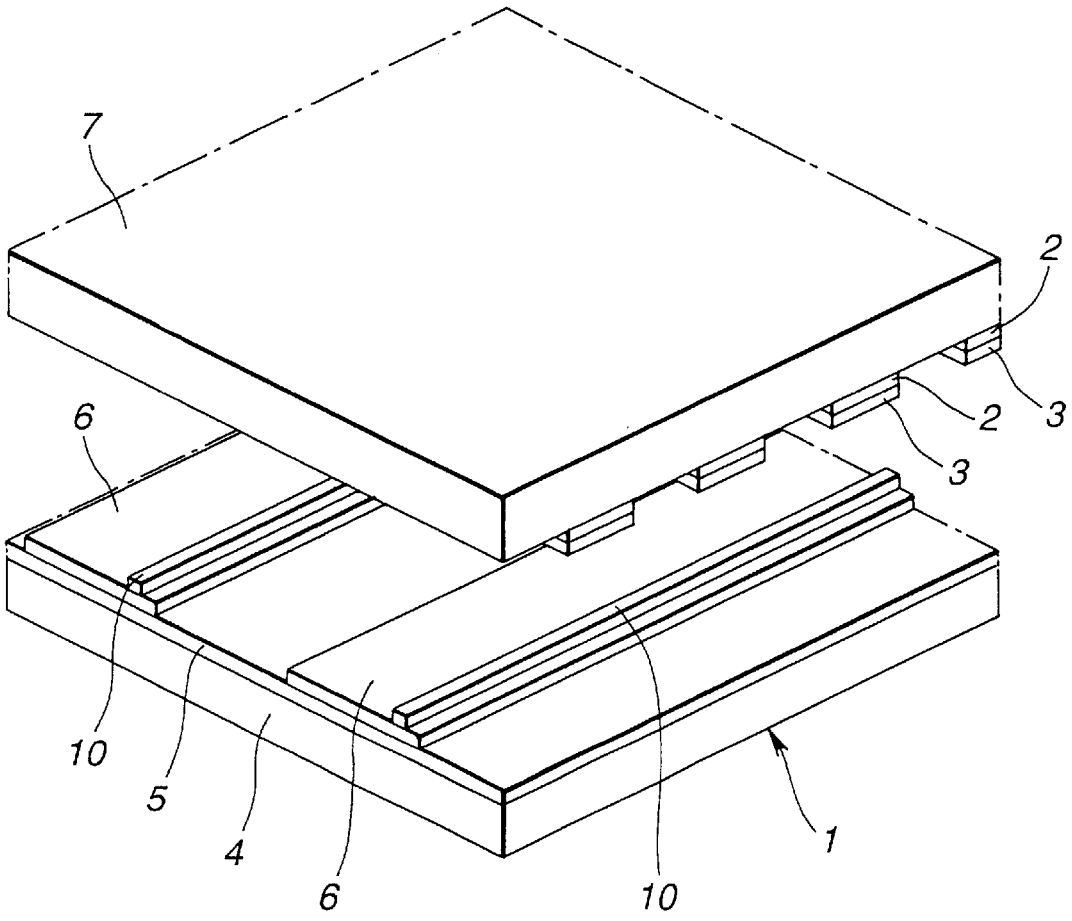
FIG. 6 is a perspective view showing a configuration of a display apparatus using another electron emission device according to the present invention.

The electron emission device according to the present invention is not limited to the aforementioned configuration, but can also have a configuration including a bus electrode 10 as shown in FIG. 6. The electron emission device shown in FIG. 6 includes; the glass substrate 4; the undercoat glass 5 covering the glass substrate 4; the cathode electrode 6 having the conductive fine particles 6A such as graphite particles arranged via the undercoat glass 5 on the glass substrate 4; and the bus electrode 10 formed along the cathode electrode 6 and having a lower electric resistance than the cathode electrode 6.

In this electron emission device 1, a power source is connected to the bus electrode 10 so as to apply a predetermined voltage. In this electron emission apparatus 1, a predetermined voltage is applied to the bus electrode 10 so as to generate a predetermined electric field for the conductive fine particles 6A.

Moreover, in this electron emission device also, as shown in FIG. 3, the conductive fine particles 6A are adhered directly to the undercoat glass 5. Furthermore, in this electron emission device 1, a voltage is applied to the bus electrode 10. Accordingly, the conductive fine particles 6A may not be connected electrically or may be connected electrically to one another.

Furthermore, as shown in FIG. 5, the electron emission device may have a configuration in which those portions of the conductive fine particles 6A directly adhered to the undercoat glass 5 are also held by the glass material 8. In this case also, a voltage is applied to the bus electrode 10 in the electron emission device. Accordingly, the conductive fine particles may not be electrically connected or may be electrically connected to one another.

In the electron emission device 1 having the aforementioned configuration, a predetermined is applied to the bus electrode 10 so as to generate a predetermined electric field. In this electron emission device 1, the electric field thus generated causes the conductive fine particles 6A to emit electrons.

Thus, in the electron emission device 1, the bus voltage provided has a lower electric resistance than the cathode electrode 6, so that a voltage to be applied can be set almost regardless of the electrical resistance of the cathode electrode 6 itself. That are in this electron emission device 1, even if the conductive fine particles 6A is at a lower density and the cathode electrode 6 has a higher electrical resistance, it is possible to generate a desired electric field by applying a voltage to the bus electrode 10.

Figure 7:
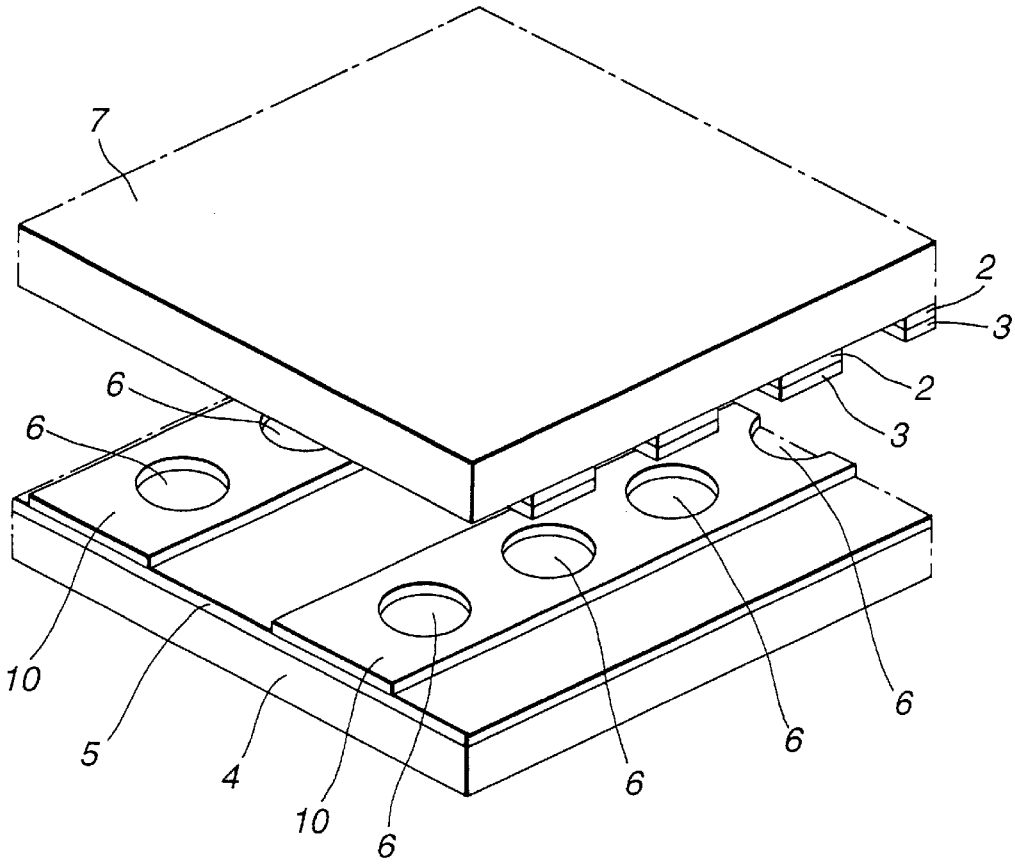
FIG. 7 is a perspective view showing a configuration of a display apparatus using still another electron emission device according to the present invention.

Moreover, in the electron emission device 1 according to the present invention, the bus electrode 10 is not limited to the one formed alone the cathode electrode, but can be formed in stripes on the glass substrate 4 as shown in FIG. 7.

In this case, the electron emission device 1 includes: the glass substrate 4; the cathode electrode 6 containing a plurality of conductive particles 6A formed on the glass substrate 4 at a position corresponding to a pixel; and the bus electrode 10 formed in stripes so as to surround the cathode electrode 6. Moreover, in this electron emission device 1 also, the conductive fine particles 6A are adhered directly to the glass substrate 4. In this electron emission device 1, both ends in the longitudinal direction of the bus electrode 10 formed in a stripe are connected to a power source.

In the electron emission device 1 having the aforementioned configuration, a predetermined voltage is applied to the bus electrode so as to generate a predetermined electric field in the vicinity of the cathode electrode 6. Thus, this electron emission device 1 can emit electrons from the cathode electrode 6 by this electric field.

Thus, in this electron emission device 1, in order to emit electrons from the cathode electrode 6, a voltage is applied to the bus electrode 10 having a low electric resistance. Accordingly, this electron emission device 1 can be driven with a low voltage compared to the type in which a voltage is applied to the cathode electrode 6.

Figure 8:
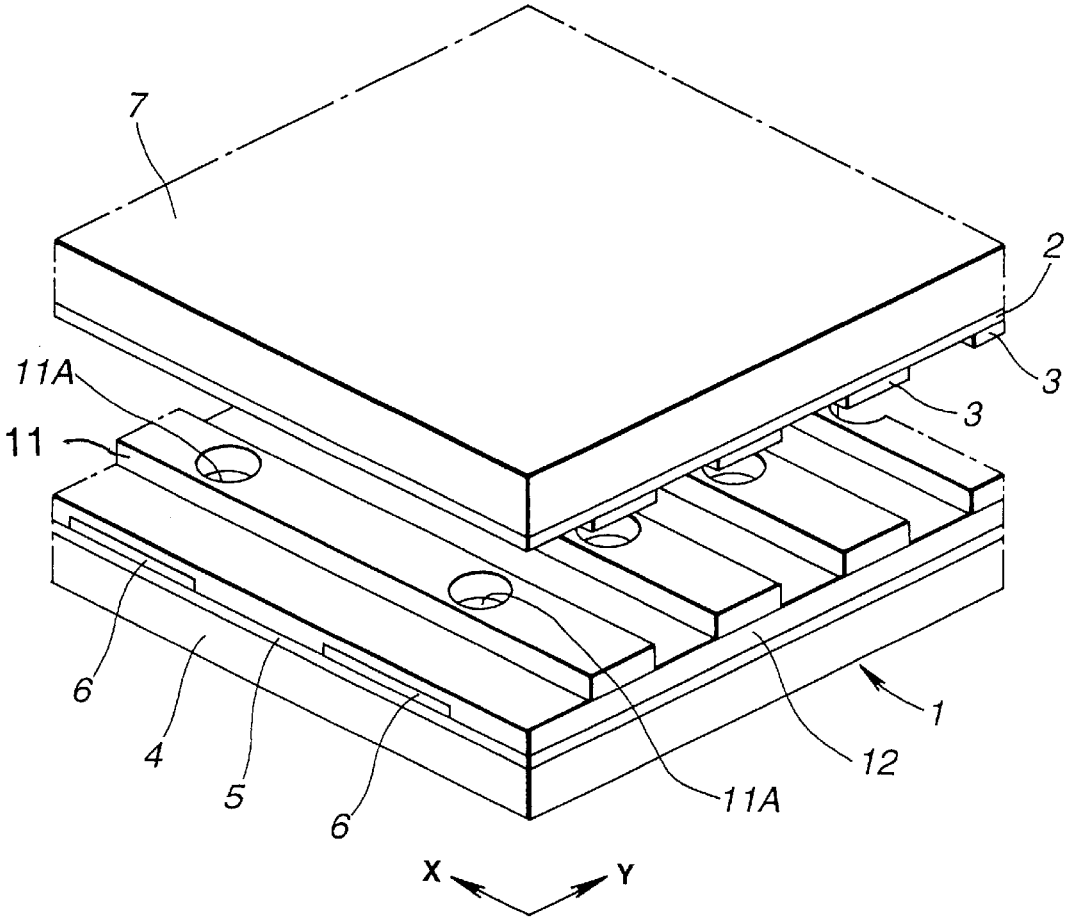
FIG. 8 is a perspective view showing a configuration of a display apparatus using still another electron emission device according to the present invention.

On the other hand, the electron emission device 1 according to the present invention is not to be limited to the aforementioned configuration but may have a configuration including a gate electrode 11 as shown in FIG. 8.

That is, as shown in FIG. 8, the electron emission device 1 includes: the glass substrate 4; the undercoat glass 5; the cathode electrode 6 having the conductive fine particles 6A such as graphite particles provided via the undercoat glass 5 on the glass substrate 4; and the gate electrode 11 provided via an insulation layer 12 on the cathode electrode 6. Moreover, in this electron emission device also, the conductive fine particles 6A are adhered directly to the undercoat glass 5 as shown in FIG. 3.

Moreover, this electron emission device, as shown in FIG. 5, may have the configuration in which the portions of the conductive fine particles 6A in direct contact with the undercoat glass 5 are held by the glass material 8.

In this electron emission device 1, a plurality of cathode electrodes 6 are formed in parallel to one another in Y direction in FIG. 8. Moreover, a plurality of gate electrodes 11 are formed in parallel to one another in X direction in FIG. 8. That is, in this electron emission device 1, the cathode electrodes 6 and the gate electrodes 11 are arranged so as to form two-level crossings.

In this electron emission device 1, each of the two-level crossings formed by the gate electrode 11 and the cathode electrode 6 constitutes a pixel. Accordingly, a number of gate electrodes 11 are formed to be identical to the number of the fluorescent bodies in the display apparatus. In this electron emission device, an opening 11A is formed in the gate electrode 11 and the insulation layer 12 corresponding to a pixel. The conductive fine particles 6A are exposed from this opening 11A. That is, in this electron emission device 1, the conductive fine particles 6A are exposed only to the portions corresponding to the pixels in the display apparatus.

Moreover, in the display apparatus using this electron emission device 1, as shown in FIG. 8, the anode electrode 2 is formed over the entire surface of the front side glass substrate 7.

In the electron emission device 1 having the aforementioned configuration, a predetermined voltage is applied to the cathode electrode 6 and another predetermined voltage is applied to the gate electrode 11. Here, a positive voltage of several tens of volts is applied to the gate electrode 11 with respect to the cathode electrode 6. This generates a predetermined electric field around the cathode electrode 6 and the cathode electrode emits electrons.

Furthermore, in this electron emission device 1, each two-level crossing of the gate electrode 11 and the cathode electrode 6 corresponds to one pixel. Accordingly, by applying a predetermined voltage to the gate electrode 11 and the cathode electrode 6, it is possible to make a desired pixel to emit light. Thus, in the electron emission device 1, it is possible to emit electrons for a desired pixel by selecting a gate electrode 11 and a cathode electrode 6 to which a voltage is applied. Consequently, in the display apparatus using this electron emission device 1, the anode electrode 2 can be formed on the entire surface of the front side glass substrate 7. That is, unlike the case shown in FIG. 2, the anode electrode merely generates an electric field to accelerate the electrons emitted.

In this electron emission device also, the conductive fine particles 6A are graphite particles or the like. When compared to the conventional spindt type electron emission device, it is possible to emit electrons with a small electric field. Accordingly, in this electron emission device 1, it is possible to reduce the voltage required for emitting a predetermined quantity of electrons.

Furthermore, the display apparatus according to the present invention using the electron emission device as shown in FIG. 8 may have a configuration including a focus electrode 13.

Figure 9:
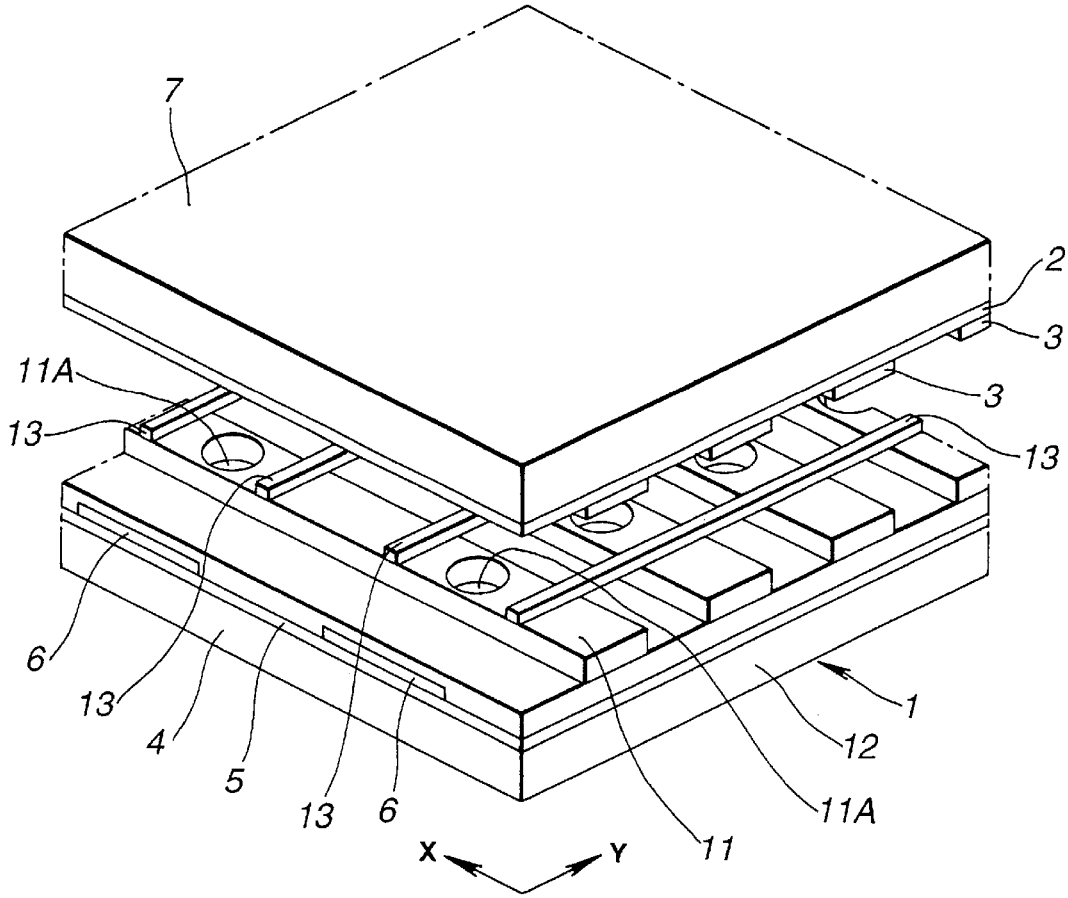
FIG. 9 is a perspective view showing a configuration of another display apparatus according to the present invention.

That is, as shown in FIG. 9, the display apparatus includes a plurality of focus electrode 13 formed in parallel (X direction in FIG. 9) to the cathode electrode 6 over a plurality of gate electrodes 11. This focus electrode 13 is formed adjacent to the opening formed in the gate electrode 11 and has both ends in the longitudinal direction connected to a power source.

In the electron emission device 1 having the aforementioned configuration, as has been described above, a predetermined voltage is applied to the focus electrode 13 when emitting electrons. This causes the focus electrode 13 to generate a predetermined electric field. In this electron emission device 1, focusing of the electrons emitted is performed by the electric field generated by the focus electrode 13, so as to attack a desired fluorescent body. That is, in this electron emission device 1, electrons emitted from a cathode electrode 6 corresponding to one pixel will not strike adjacent pixels. Accordingly, in this electron emission device 1, it is possible to prevent irregular coloring when displaying an image on the display apparatus. It should be noted that the focus electrode 13 is not limited to the aforementioned configuration but may have any configuration so as to focus emitted electrons to regulate their paths.

Moreover, the display apparatus according to the present invention is not limited to the aforementioned configuration, but may have a configuration, for example, where the longitudinal direction of the fluorescent body 3 formed in stripe intersects the longitudinal direction of the gate electrode 11. Moreover, the display apparatus may have fluorescent bodies formed in dots.

Next, explanation will be given on a production method for producing the aforementioned electron emission device used in the FED.

Figure 10:
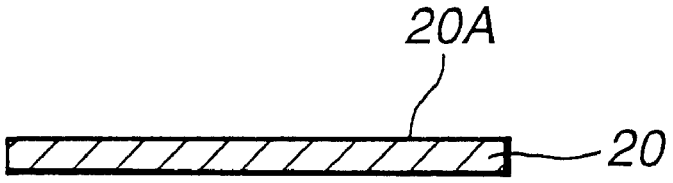
FIG. 10 is a cross sectional view showing a glass substrate for explanation of an electron emission device production method according to the present invention.

Firstly as shown in FIG. 10, a glass substrate 20 of a thin plate shape is prepared. This glass substrate 20 has a main surface 20A which is highly flattened and smoothed.

Figure 11:
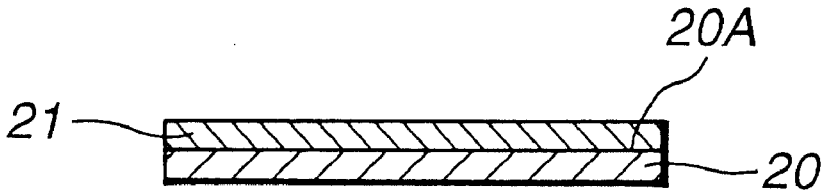
FIG. 11 is a cross sectional view showing the glass substrate and an undercoat glass for explanation of an electron emission device production method according to the present invention.

Next, as shown in FIG. 11, an undercoat glass 21 is formed on the main surface 20A of this glass substrate 20. This undercoat glass 21 is made from an absorption type glass applied by way of a so-called printing method, so as to have a film thickness of about 10 micrometers.

Figure 12:
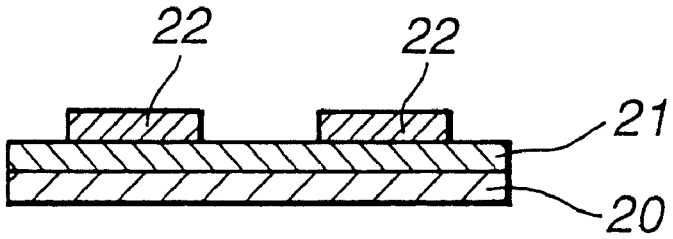
FIG. 12 is a cross sectional view showing the glass substrate, the undercoat glass, and a conductive paste for explanation of an electron emission device production method according to the present invention.

Next, as shown in FIG. 12, a conductive paste 22 containing conductive particles is applied onto the undercoat glass 21 with a predetermined width. This conductive paste 22 is made from conductive particles such as the aforementioned graphite particles kneaded together with a binder. This conductive paste is applied, for example, with a thickness of 10 micrometers formed in stripes, each stripe having a width of 100 micrometers and arranged at an interval of 100 micrometers.

In this embodiment, this conductive paste 22 is formed using the so-called screen printing method. When this screen printing method is used, it is possible to form the conductive paste 22 into a predetermined configuration without etching or the like for forming the conductive paste 22 into a desired configuration.

Moreover, when the conductive paste 22 is formed on the undercoat glass 21 having an absorption characteristic, the conductive paste 22 can be applied while the flow is controlled. Accordingly, with this method, it is possible to form an accurate configuration of the conductive paste 22 on the undercoat glass 21.

Next, the conductive paste 22 formed on the glass substrate 20 is sintered. This sintering is carried out at a temperature for completely removing the binder contained in the conductive paste 22. More specifically, when a conductive paste 22 containing graphite particles is formed with about 10 micrometers on the undercoat glass 21, the sintering is carried out at the temperature of about 480° C.

Thus, the binder is completely removed from the conductive paste 22 and the conductive fine particles are adhered directly to the undercoat glass 21. Here, the conductive fine particles are adhered to the undercoat glass 21 with the Van der Waals force.

In this method. it is also possible that the conductive paste 22 contains a glass content when sintered. In this case, the conductive paste 22 is made from the conductive fine particles such as the aforementioned graphite particles, binder kneaded with the binder and the glass content. The conductive paste 22 thus prepared is sintered so that the binder is completely removed and the glass content precipitates onto the undercoat glass 21.

Thus, the binder is removed in the sintering process and the conductive fine particles are adhered directly to the undercoat glass 21. Moreover, in this method, the conductive paste 22 contains a glass content, which precipitates to be hardened into a glass material. This glass material covers the conductive particle portions which are adhered directly to the undercoat glass.

Here, an explanation will be given on an experiment to prove that the glass material covers the portion of the conductive fine particles adhered directly to the undercoat glass 21.

Figure 13:
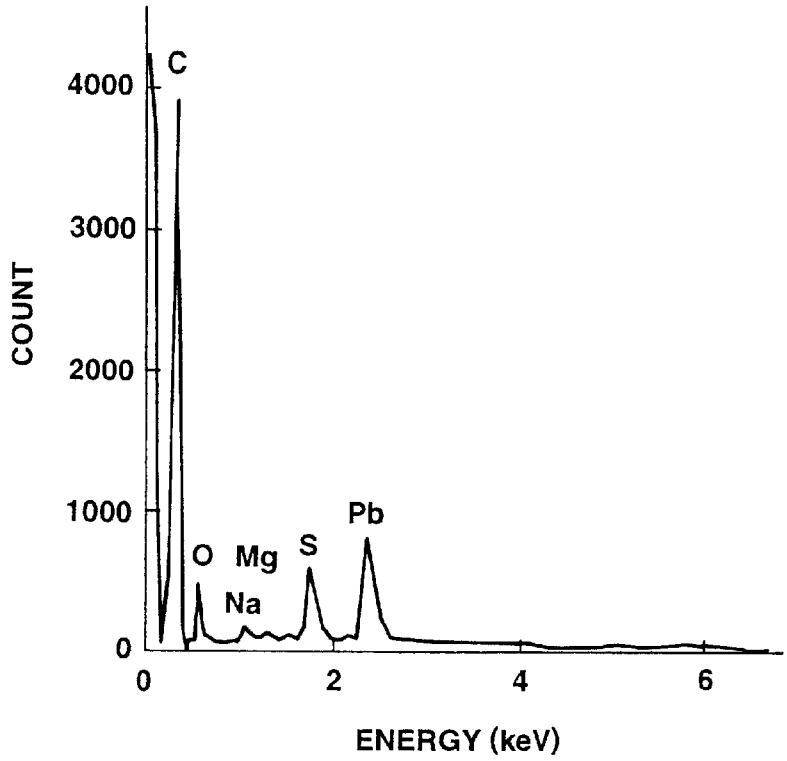
FIG. 13 shows EDX values determined after sintering the conductive paste: the horizontal axis representing the count and the vertical axis representing the energy.

Firstly, as has been described above, the conductive paste 22 is sintered and subjected to a composition analysis using an energy dispersion type X-ray spectrometer (hereinafter, referred to as EDX) with an acceleration voltage set to 10 kV. FIG. 13 shows a result of this analysis.

FIG. 13 shows a graph having a peak of C from the graphite used as the conductive fine particles and a peak of Pb. This Pb peak comes from the glass content of the conductive paste 22. This proves that the sintering of the conductive paste 22 results in the existence of a glass material besides the conductive fine particles on the undercoat glass 21.

Figure 14:
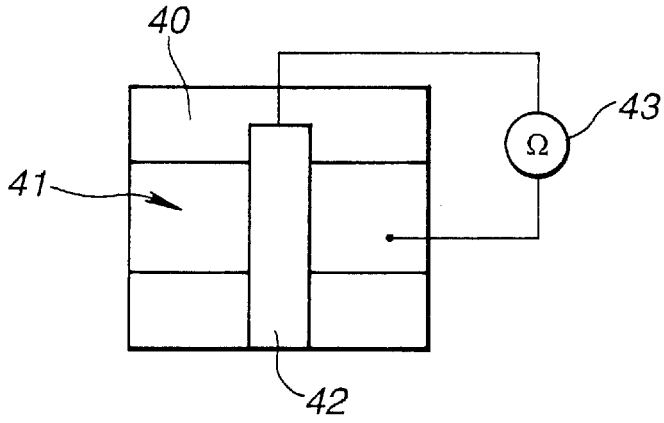
FIG. 14 is a circuit diagram for verifying the surface state of the conductive fine particles.

Moreover, as shown in FIG. 14, a conductor 41 of plate shape was formed on a substrate 40. After the conductive paste 42 was applied onto this substrate 40 and the conductor 41, sintering was carried out so that conductive fine particles were adhered directly onto the conductor 41. The conductors 41 were electrically connected to the surfaces of the conductive fine particles, so as to form a circuit for measuring a resistance between the conductor 41 and the conductive fine particles, using a resistance-meter.

Using such a circuit, a change of resistance between the conductor 41 and the conductive fine particles was measured while changing the weight ratio of the glass content and the binder against the conductive fine particles. More specifically, a conductive paint was prepared firstly for 70% by weight of conductive particles with respect to the glass content and the binder. This conductive paint as having 100% density was diluted by the glass content and binder to obtain a conductive paint of the desired density.

Figure 15:
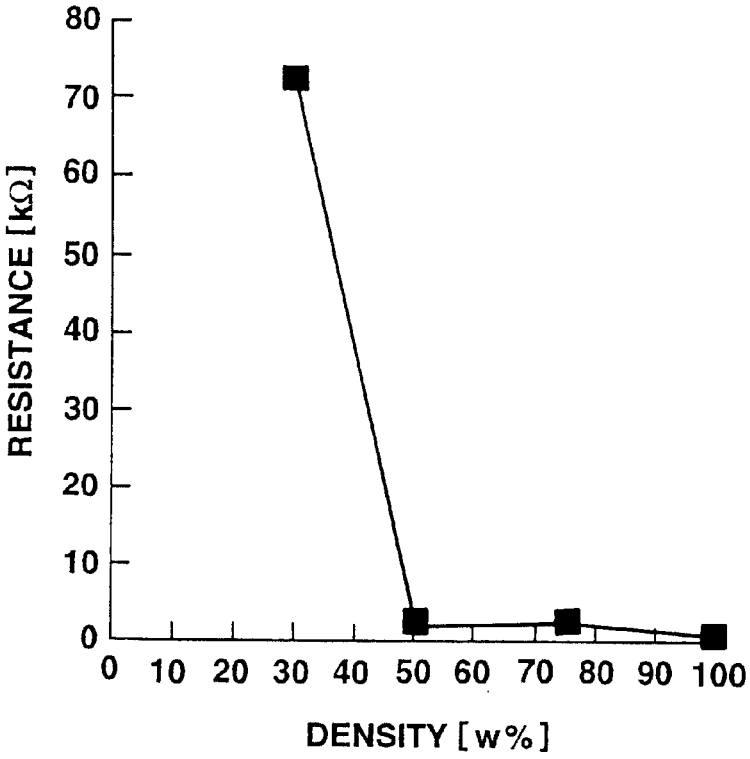
FIG. 15 shows a relationship between the density and resistance determined using the circuit shown in FIG. 13.

FIG. 15 shows a result of this measurement. As is clear from this FIG. 15, a large resistance value was exhibited at the density of about 30%. At the density of about 40%, the resistance value was suddenly decreased. At the density of about 50% or above, the resistance value was very small. The sudden change in the resistance value is the point where the conductive fine particles are exposed outward from the surface. Accordingly, in order to expose the conductive fine particles, it is preferable that the density be 40% or more in the experiment shown in FIG. 15. Moreover, in order to sufficiently expose the surfaces of the conductive fine particles, it is preferable that the density be about 50% or more in the experiment shown in FIG. 15.

These experiments proved that the conductive paste containing a glass content when sintered has a configuration where a glass material is formed to surround the conductive particle portions adhered directly to the substrate. Thus, in this method, the conductive paste 22 containing a glass content enables the conductive fine particles to firmly adhere directly to the undercoat glass 21.

Next, a surface treatment is carried out to the conductive fine particles adhered directly onto the undercoat glass 21 as has been described above. This surface treatment need not be carried out when the sintering can completely remove impurities such as a binder. This surface treatment may be, for example, plasma etching, electrolysis, washing using an acid such as nitrate, and the like.

After this surface treatment, the surfaces of the conductive fine particles are completely cleaned of impurities such as the binder. Accordingly. the conductive fine particles after the surface treatment have no problem in electron emission and can emit electrons easier than the if not subjected to a surface treatment. Consequently, when this surface treatment is carried out, it is possible to further reduce the threshold value for emitting electrons, enabling electron emission with a lower voltage.

Figure 16:
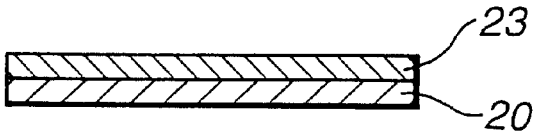
FIG. 16 is a cross sectional view showing the glass substrate and the conductive paste for explanation of an electron emission device production method according to another embodiment of the present invention.
Figure 17:
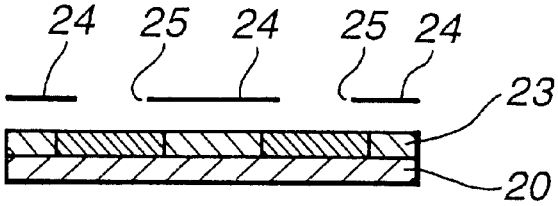
FIG. 17 is a cross sectional view showing the glass substrate, conductive paste, and mask for explanation of the electron emission device production method according to another embodiment of the present invention.
Figure 18:
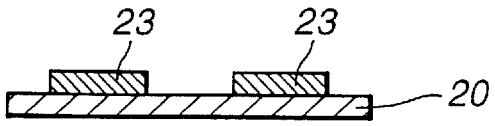
FIG. 18 is a cross sectional view showing the glass substrate and cathode electrode for explanation of the electron emission device production method according to another embodiment of the present invention.

However, the electron emission device production method according to the present invention is not limited to the aforementioned method for applying the conductive paste 22 by way of the screen printing method but can be a method using a photo-sensitive paste made from a photo-sensitive resin as shown in FIG. 16 to FIG. 18, for example.

In this case, firstly, as shown in FIG. 16, a photo-sensitive paste 23 containing conductive fine particles and a photo-sensitive resin is applied over the entire surface of a main surface 20A of the glass substrate 20. Here, the photo-sensitive paste 23 is applied by way of the spin coat method, for example, with a thickness of about 10 micrometers.

The photo-sensitive resin is a resin which has the characteristic of being hardened by exposure to light. For example, it is possible to use a diazo compound. When the diazo compound is used, the photo-sensitive resin is hardened when exposed to ultraviolet rays. Moreover, this photo-sensitive paste 23 contains 70% weight of conductive fine particles with respect to the photo-sensitive resin.

It should be noted that the method for applying the photo-sensitive paste 23 containing this photo-sensitive resin is not limited to the aforementioned spin coat method. It is also possible, for example, to flow the photo-sensitive paste 23 over the glass substrate 20 or to use the gravure roll method. Moreover, the weight % of the conductive fine particles in the photo-sensitive paste 23 is not limited to the aforementioned 70% but can have any value according to the glass substrate 20 serving as an undercoat and the sintering condition.

Next, as shown in FIG. 17, a mask 24 is used for exposure. This mask 24 has a size to cover almost the entire surface of the glass substrate and has openings 25, each having a width of about 100 micrometers and formed at an interval of about 100 micrometers. That is, in this mask 24, the openings 25 are formed at positions corresponding to the configuration of the cathode electrode to be formed.

Here, the mask 24 is accurately positioned in contact with or apart from the surface of the photo-sensitive paste 23 formed on the glass substrate 20, so that only portions of the photo-sensitive paste 23 are exposed from the openings 25 formed on this mask 24 to radiation of ultraviolet rays.

Next, as shown in FIG. 18, the entire surface of the photo-sensitive paste is made to react with a developing liquid so as to remove the unexposed portions of the photo-sensitive paste. Here, the developing liquid is, for example, an aqueous solution of sodium carbonate which is sprayed by jet over the photo-sensitive paste 23 or the photo-sensitive paste 23 is impregnated by the solution. Thus, the photo-sensitive paste 23 hardened by exposure remains in a predetermined area on the glass substrate 20.

In the same way as has been described above, sintering and surface treatment are carried out so as to completely remove the photo-sensitive paste 23, so that conductive fine particles can be adhered directly onto the glass substrate 20. It should noted that in this case also, it is possible that the photo-sensitive paste 23 contains a glass content so as to firmly fix the conductive fine particles with the glass material.

In this method, by exposing a predetermined area of the photo-sensitive paste 23, a desired configuration of the photo-sensitive paste 23 is formed on the glass substrate 20. Accordingly, in this method, by increasing the accuracy of the mask 24, it is possible to obtain a highly accurate configuration of the photo-sensitive paste 23 remaining on the glass substrate 20. Consequently, in this method, it is possible to form the cathode electrode in fine stripes.

Moreover, the electron emission device production method according to the present invention may be a so-called lift-off method as shown in FIG. 19 to FIG. 24.

Figure 19:
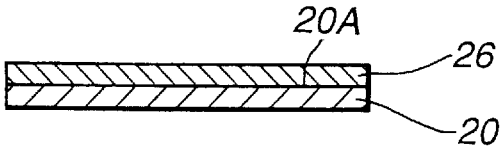
FIG. 19 is a cross sectional view showing the glass substrate and the conductive paste for explanation of an electron emission device production method according to still another embodiment of the present invention.

In this case, firstly, as shown in FIG. 19, a conductive paste 26 containing conductive fine particles and binder is formed over the entire surface of the main surface 20A of the glass substrate 20. Here, the conductive paste 26 may be applied by any of the screen printing method, deposition method, sputtering method, the CVD method, or the like.

Figure 20:
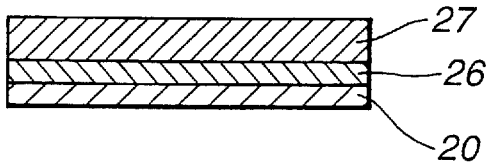
FIG. 20 is a cross sectional view showing the glass substrate, conductive paste, and photo-resist for explanation of the electron emission device production method according to still another embodiment of the present invention.

Next, as shown in FIG. 20, a photo-resist 27 of ultraviolet-ray hardening type is formed over the entire surface of the conductive paste 26. This photo-resist 27 may be the one which is generally used for thin film formation. This photo-resist 27 is applied using the method such as the spin coating method or the gravure roll method.

Figure 21:
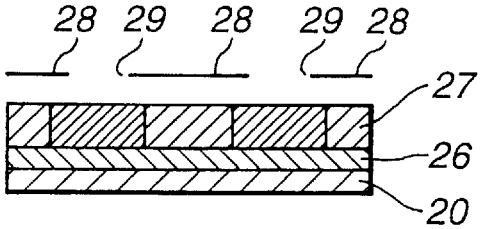
FIG. 21 is a cross sectional view showing the glass substrate, conductive paste, photo-resist, and mask for explanation of the electron emission device production method according to still another embodiment of the present invention.

Next, as shown in FIG. 21, a mask 28 is used to expose a desired area on the photo-resist 27. Here, the mask 28 has an opening 29 corresponding to a cathode electrode in the same way as in the method shown in FIG. 13. By using this mask 28, the photo-resist 27 is exposed to light so as to harden the photo-resist 27 at a position corresponding to the cathode electrode.

Figure 22:
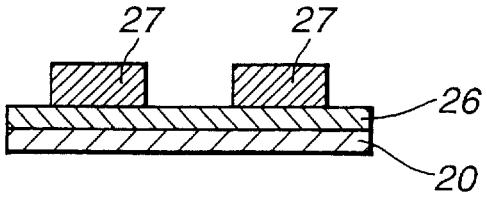
FIG. 22 is a cross sectional view showing the glass substrate, conductive paste, and photo-resist for explanation of the electron emission device production method according to still another embodiment of the present invention.

Next, as shown in FIG. 22, a developing liquid is used to remove an unexposed portion of the photo-resist 27. Here, the developing liquid may be sprayed over the photo-resist 27 or the photo-resist may be impregnated with the developing liquid. Thus, the photo-resist 27 remains only on the conductive paste 26 that becomes the cathode electrode.

Figure 23:
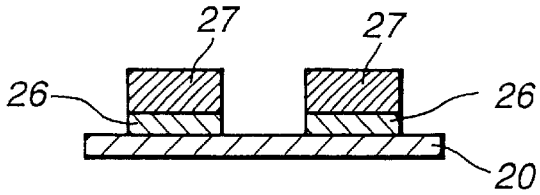
FIG. 23 is a cross sectional view showing the glass substrate, conductive paste, and photo-resist for explanation of the electron emission device production method according to still another embodiment of the present invention.

Next, as shown in FIG. 23, the conductive paste 26 is removed excluding the portion where the photo-resist 27 remains. More specifically, the conductive paste 26 is removed by a method such as electrolysis or dry etching using the hardened photo-resist 27 as a mask. Thus, the conductive paste 26 and the photo-resist 27 remain on the glass substrate at a position opposing to the cathode electrode.

Figure 24:
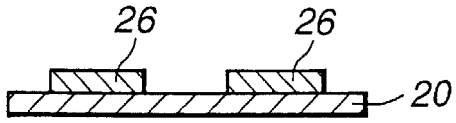
FIG. 24 is a cross sectional view showing the glass substrate and conductive paste for explanation of the electron emission device production method according to still another embodiment of the present invention.

Next, as shown in FIG. 24, an organic solvent is used to remove the photo-resist 27. Thus, the photo-resist 27 is peeled off from the conductive paste 26 to expose outward the conductive paste 26 formed at a position corresponding to the cathode electrode.

In the same way as has been described above, sintering and surface treatment are carried out to completely remove impurities such as photo-resist 27 and binder, so that conductive fine particles can be adhered directly onto the glass substrate 20. It should be noted that in this case also it is possible that the photo-resist 27 contains a glass content so that the conductive fine particles can be firmly fixed by the glass material.

In this method, similarly as in the aforementioned case using the photo-sensitive paste 23, by forming the mask 28 with a high accuracy, it is possible to form a highly accurate configuration of the cathode electrode. Accordingly, in this method, it is possible to easily form a cathode electrode having a small width and small interval.

It should be noted that in this method, it is possible to employ a so-called sand blast method when removing the photo-resist 26 from the glass substrate 20 excluding the area having the remaining photo-resist 27. With this sand blast method, ultra-fine sand particles are sprayed in the same direction for etching of the conductive paste 26.

Furthermore, the electron emission device production method according to the present invention may employ a so-called lift-off method as shown in FIG. 25 to FIG. 29.

Figure 25:
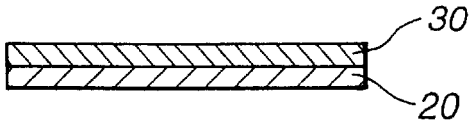
FIG. 25 is a cross sectional view showing a glass substrate and photo-resist for explanation of an electron emission device production method according to yet another embodiment of the present invention.

In this case, firstly, as shown in FIG. 25, a film of photo-resist 30 is formed to cover the entire surface of the main surface 20A of the glass substrate 20. Here, the photo-resist 30 is applied by a method such as the spin coat method and gravure roll method with a film thickness of about 1 micrometer. It should be noted that the film thickness of the photo-resist 30 is not limited to this value but may be about 20 micrometers or less.

Figure 26:
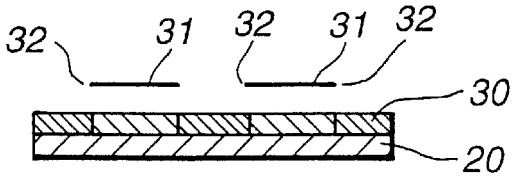
FIG. 26 is a cross sectional view showing a glass substrate, photo-resist, and mask for explanation of an electron emission device production method according to yet another embodiment of the present invention.

Next, as shown in FIG. 26, a mask 31 is used to expose a predetermined area to light. Here, the mask 31 has an opening 32 formed to expose the photo-resist 30 excluding the area where a cathode electrode is to be formed.

Figure 27:
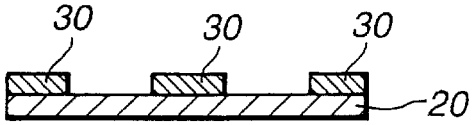
FIG. 27 is a cross sectional view showing a glass substrate and photo-resist for explanation of an electron emission device production method according to yet another embodiment of the present invention.

Next, as shown in FIG. 27, a developing liquid is used to remove the photo-resist 30 which has of the predetermined area. Thus, the photo-resist 30 hardened remains excluding the area where the cathode electrode is to be formed.

Figure 28:
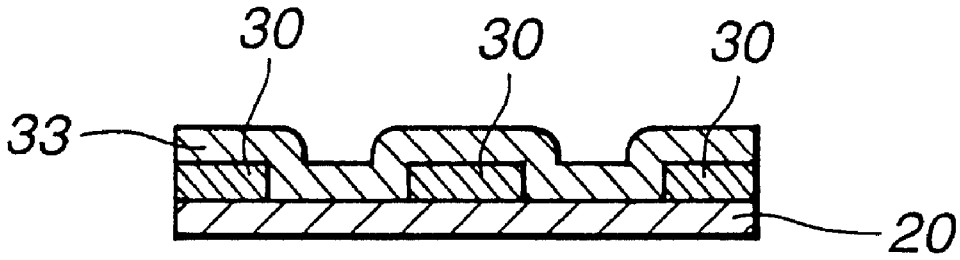
FIG. 28 is a cross sectional view showing a glass substrate, photo-resist, and conductive paste for explanation of an electron emission device production method according to yet another embodiment of the present invention.

Next, as shown in FIG. 28, a conductive paste 33 is applied over the entire surface having the photo-resist remaining in the predetermined area. The conductive paste 33 may be formed into a film by way of the screen printing method, deposition method, sputtering method, CVD method, or the like. Here, the film of the conductive paste 33 is formed with a thickness of about 10 micrometers. The thickness is not to be limited to this value but may be about 20 micrometers or less. Thus, the conductive paste 33 is applied to cover the photo-resist 30 remaining on the glass substrate 20 and over the exposed glass substrate 20.

Figure 29:
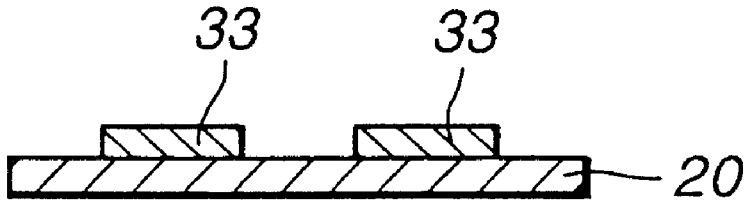
FIG. 29 is a cross sectional view showing a glass substrate and conductive paste for explanation of an electron emission device production method according to yet another embodiment of the present invention.

Next, as shown in FIG. 29, an organic solvent is used to remove the photo-resist 30 from the glass substrate 20. Thus, the photo-resist 30 and the conductive paste 33 formed on this photo-resist 30 are peeled off from the glass substrate 20, and only the conductive paste 33 formed at a position corresponding to the cathode electrode remains on the glass substrate 20.

In the same way as in the aforementioned method, sintering and surface treatment are carried out to completely remove impurities such as the photo-resist 30 and binder, so that conductive fine particles can be adhered directly onto the glass substrate 20. It should be noted that in this case also, the conductive paste 33 may contain a glass constituent so that the conductive fine particles are firmly fixed by the glass material.

In this method, there is no need of forming a film of photo-resist 30 on the cathode electrode and accordingly, it is possible to reduce impurities on the cathode electrode. Consequently, in this method it is possible to effectively remove binder by sintering. As a result, in this method, it is possible to make the surfaces of the conductive fine particles appropriate for emitting electrons.

As has been described above, in the electron emission device production method according to the present invention, a conductive paste containing a binder and the like is applied onto a glass substrate, which is then sintered to remove the binder. Thus, in this method conductive fine particles are adhered directly onto the glass substrate. Here, the conductive fine particles are fixed to the glass substrate by the Van der Waals force.

Thus, this method enables to adhere the conductive fine particles directly onto the glass substrate and does not require any particular adhesive layer for adhering the conductive fine particles.

In the conventional method where the conductive fine particles are used as a cathode electrode, an adhesive layer is required, whose thickness need be accurately controlled. This thickness control should be carried out on the order of several Angstroms, which makes the production quite difficult.

In the production method according to the present invention, the conductive fine particles can be used as a cathode electrode without carrying out such an accurate thickness control. Thus, in this method, it is possible to easily form the cathode electrode. Moreover, this production method reduces the production materials because no adhesive layer is required.

Moreover, in this method, a surface treatment is carried out after sintering, so as to activate the surface of the conductive fine particles. That is, the surface treatment can remove impurities such as a binder completely from the conductive fine particles, so that the conductive fine particles can easily emit electrons.

Furthermore, in this method, a conductive paste containing a glass constituent is sintered so that the portions of the conductive fine particles adhered directly to the substrate can be surrounded by glass material. Thus, the conductive fine particles can be firmly fixed directly onto the substrate. Accordingly, in this method, it is possible to prevent peeling of the conductive fine particles from the substrate, which significantly increases the productivity.

Furthermore, the electron emission device produced according to this method has a cathode electrode having a simplified configuration compared to the conventional spindt type electron emission device. Accordingly, this method can produce a cathode electrode with an accuracy of several microns compared to the conventional method requiring an accuracy of submicrons. Thus, the method of the present invention significantly mitigates the required production accuracy, facilitating production of a large-size display.

The present invention that has been detailed for each of the embodiments is not to be limited to these embodiments but can be modified in various ways including configurations, materials, dimensions, and production methods within the scope of invention.

As has been detailed above, in the electron emission device according to the present invention, the conductive fine particles are adhered directly to the substrate and accordingly, electron emission is assured by a predetermined electric field. That is, in the electron emission device, the conductive fine particles can effectively emit electrons without any hindrance.

Moreover, in the electron emission device production method according to the present invention, a conductive paint containing conductive fine particles and binder are sintered so that the conductive fine particles are adhered directly onto the substrate. Accordingly, in this method, there is no need to provide an adhesive layer or the like which requires an accurate control of film thickness. Consequently, in this method, it is possible to easily produce an electron emission device using conductive fine particles.

Furthermore, in the display apparatus according to the present invention employing an electron emission device in which a cathode electrode is constituted by conductive fine particles adhered directly onto the substrate, it is possible to assure electron emission from the conductive fine particles. Accordingly, in this display apparatus, the fluorescent plane can selectively emit light. Consequently, the display apparatus according to the present invention significantly increases the luminance.

What is claimed is:

1. An electron emission device comprising:

a cathode electrode of conductive fine particles formed on a substrate, wherein portions of said conductive fine particles are adhered directly onto said substrate and are held by Van der Waals forces, and wherein electrons are emitted from said conductive fine particles when a predetermined electric field is applied, said electrons being emitted are increased by increasing a density of said conductive fine particles.

2. An electron emission device as claimed in claim 1, wherein said conductive fine particles are sintered to be adhered directly onto said substrate.

3. An electron emission device as claimed in claim 2, wherein said conductive fine particles are sintered and electrically connected to one another.

4. An electron emission device as claimed in claim 1, wherein portions of said conductive fine particles adhered onto said substrate are held by a glass material.

5. An electron emission device as claimed in claim 1, wherein said cathode electrode is formed on a conductive layer on said substrate.

6. An electron emission device as claimed in claim 1, wherein said cathode electrode is formed in a stripe shape and a bus electrode is formed from a conductive material along one longitudinal side of said stripe.

7. An electron emission device as claimed in claim 1, wherein a gate electrode is formed on an insulation layer over said cathode electrode, so that a voltage is applied to said gate electrode to generate an electric field.

8. An electron emission device as claimed in claim 1, wherein said conductive fine particles comprise graphite particles.

9. An electron emission device as claimed in claim 1, wherein said conductive fine particles comprise a mixture of graphite and barium oxide.

10. An electron emission device as claimed in claim 1, wherein said conductive fine particles comprise a mixture of strontium, oxide, or metal with graphite particles.

11. An electron emission device as claimed in claim 1, wherein said conductive fine particles comprise diamond containing impurities from the group that includes nitrogen, phosphorous, boron, and triazol.

12. An electron emission device as claimed in claim 1, wherein said conductive fine particles comprise diamond-like carbon containing impurities from the group that includes nitrogen, phosphorous, boron, and triazol.

13. An electron emission device as claimed in claim 1, wherein said conductive fine particles comprise silicon carbide.

14. An electron emission device as claimed in claim 1, wherein said conductive fine particles consists of graphite as a single substance.

15. An electron emission device as claimed in claim 14, wherein a threshold voltage is on the order of $5\times10^4$ to $5\times10^5$ V/cm.

16. An electron emission device as claimed in claim 1, wherein said electron emission device is driven in a vacuum on the order of $10^{-6}$ to $10^{-7}$ Torr.

17. A display apparatus comprising:

an electron emission device including a cathode electrode having a plurality of conductive fine particles adhered directly on a substrate and are held by Van der Waals forces;

an anode electrode arranged to oppose to said electron emission device so as to generate an electric field to accelerate electrons emitted from said electron emission device; and a fluorescent plane arranged on said anode electrode to be struck by electrons accelerated by said anode electrode, wherein said cathode electrode having said plurality of conductive fine particles emits electrons when a predetermined electric field is present and said electrons emitted from said cathode electrode cause said fluorescent plane to emit light.

18. A display apparatus as claimed in claim 17, said apparatus further comprising:

a focus electrode arranged between said electron emission device and said anode electrode, so as to focus electrons emitted from said conductive fine particles.

19. A display apparatus as claimed in claim 17, wherein said electron emission device has said cathode electrode formed in a plurality of stripes parallel to one another;

said anode electrode is formed in a plurality of stripes arranged in a direction perpendicular to said cathode electrode stripes; and electrons are emitted from said conductive fine particles in an area of said cathode electrode intersecting with said anode electrode.

20. A display apparatus as claimed in claim 17, wherein said electrons are increased as by increasing the density of said conductive fine particles.

21. A display apparatus as claimed in claim 17, further comprising:

a bus electrode formed on the entire length of said cathode electrode, wherein a voltage applied said bus electrode generates said predetermined electric field.

22. A display apparatus as claimed in claim 21, wherein said voltage is applied to the ends of said bus electrode.

23. A display apparatus as claimed in claim 17, further comprising:

an insulation layer formed on said cathode electrode;

a gate electrode formed on said insulation layer; and a focus electrode formed over said gate electrode, said focus electrode focusing said electrons emitted from said conductive fine particles.

24. A display apparatus as claimed in claim 17, further comprising:

an insulation layer formed on said cathode electrode;

a gate electrode formed on said insulation layer; and a plurality of focus electrodes formed over said gate electrode, said plurality of focus electrodes focusing said electrons emitted from said conductive fine particles.

25. A display apparatus as claimed in claim 24, wherein said plurality of focus electrodes are formed adjacent to an opening within said gate electrode.

26. A display apparatus as claimed in claim 24, wherein the ends of each focus electrode of said plurality of focus electrodes are connected to a power source.

27. An electron emission device as claimed in claim 17, wherein portions of said conductive fine particles adhered onto said substrate are held by a glass material.

28. A display apparatus comprising:

a substrate;

a plurality of cathode electrodes on said substrate, each cathode electrode of said plurality of cathode electrodes having a plurality of conductive fine particles adhered directly onto said substrate and are held by Van der Waals forces;

an insulation layer formed on said plurality of cathode electrodes;

a plurality of gate electrodes formed on said insulation layer, each gate electrode of said plurality of gate electrodes having a plurality of openings formed therein;

a plurality of focus electrodes formed over said plurality of gate electrodes, said plurality of focus electrodes focusing electrons emitted from said conductive fine particles.

29. A display apparatus as claimed in claim 28, wherein a single focus electrode of said plurality of focus electrodes is in association with said each gate electrode.

30. A display apparatus as claimed in claim 28, wherein a pair of said plurality of focus electrodes are in association with said each gate electrode.

31. An electron emission device as claimed in claim 28, wherein portions of said conductive fine particles adhered onto said substrate are held by a glass material.

* * * * *